US008715011B2

(12) United States Patent
Chen et al.

(10) Patent No.: US 8,715,011 B2
(45) Date of Patent: May 6, 2014

(54) ELECTRONIC DEVICE AND AUDIO JACK THEREOF

(75) Inventors: Chien-Hung Chen, Taoyuan County (TW); Chih-Wei Tu, Taoyuan County (TW); Yuan-Yao Tu, Taoyuan County (TW); Wei-Syuan Lin, Taoyuan County (TW); Pei-Hao Huang, Taoyuan County (TW); Ping-Huang Yang, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 75 days.

(21) Appl. No.: 13/404,727

(22) Filed: Feb. 24, 2012

(65) Prior Publication Data

US 2013/0225000 A1 Aug. 29, 2013

(51) Int. Cl.
*H01R 24/04* (2006.01)

(52) U.S. Cl.
USPC ..... 439/669; 439/188

(58) Field of Classification Search
USPC ..... 439/669, 668, 188, 489
See application file for complete search history.

(56) References Cited

U.S. PATENT DOCUMENTS

| | | | | |
|---|---|---|---|---|
| 7,942,705 | B2 * | 5/2011 | Murphy et al. | 439/668 |
| 2007/0218773 | A1 * | 9/2007 | Uno et al. | 439/668 |
| 2007/0218774 | A1 * | 9/2007 | Han et al. | 439/668 |
| 2010/0240259 | A1 * | 9/2010 | Murphy et al. | 439/668 |

* cited by examiner

*Primary Examiner* — Phuong Dinh
(74) *Attorney, Agent, or Firm* — Birch, Stewart, Kolasch & Birch, LLP

(57) ABSTRACT

An audio jack for receiving an audio plug includes a connection hole with a position detection portion and a first audio channel contact portion therein. When the audio plug is inserted into the connection hole to the linking position, a first audio channel connection portion of the audio plug contacts the position detection portion and the first audio channel contact portion. The position detection portion and the first audio channel contact portion respectively have a first distance and a second distance to an opening of the connection hole, wherein the second distance is smaller than the first distance.

18 Claims, 6 Drawing Sheets

ELECTRONIC DEVICE AND AUDIO JACK THEREOF

BACKGROUND OF THE INVENTION

1. Field of the Invention

The present invention relates to an electronic device and a connector thereof, and in particular relates to an electronic device and an audio jack thereof.

2. Description of the Related Art

Conventional audio jacks are usually disposed in electronic devices such as mobile phones, smart phones and notebooks for connecting an earphone or microphone thereto. In general, a detecting mechanism is disposed on the inner side of the audio jack to determine whether a connection therebetween is in ready or not. However, an inappropriate mechanism design of the conventional audio jack may cause a ghost key of electrical connection when the user inserts the audio plug into the audio jack, and this will adversely affect the accuracy of detection. To solve the aforesaid problem, how to improve the mechanism design of the conventional audio jack has become an important issue.

SUMMARY

The present invention provides an audio jack for receiving an audio plug which has a first audio channel connection portion.

In an embodiment, the audio jack comprises a connection hole, a position detection portion and a first audio channel contact portion, wherein the connection hole has an opening, and the position detection portion is disposed in the connection hole. The position detection portion has a first distance to the opening, and when the audio plug is inserted into the connection hole to a linking position, the first audio channel connection portion and the position detection portion contact each other.

The first audio channel contact portion is disposed in the connection hole, and first audio channel contact portion has a second distance to the opening, which is smaller than the first distance. When the audio plug is inserted into the connection hole to the linking position, the first audio channel connection portion is electrically connected to the first audio channel contact portion.

In addition, the present invention further provides an electronic device comprising the aforesaid audio jack.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
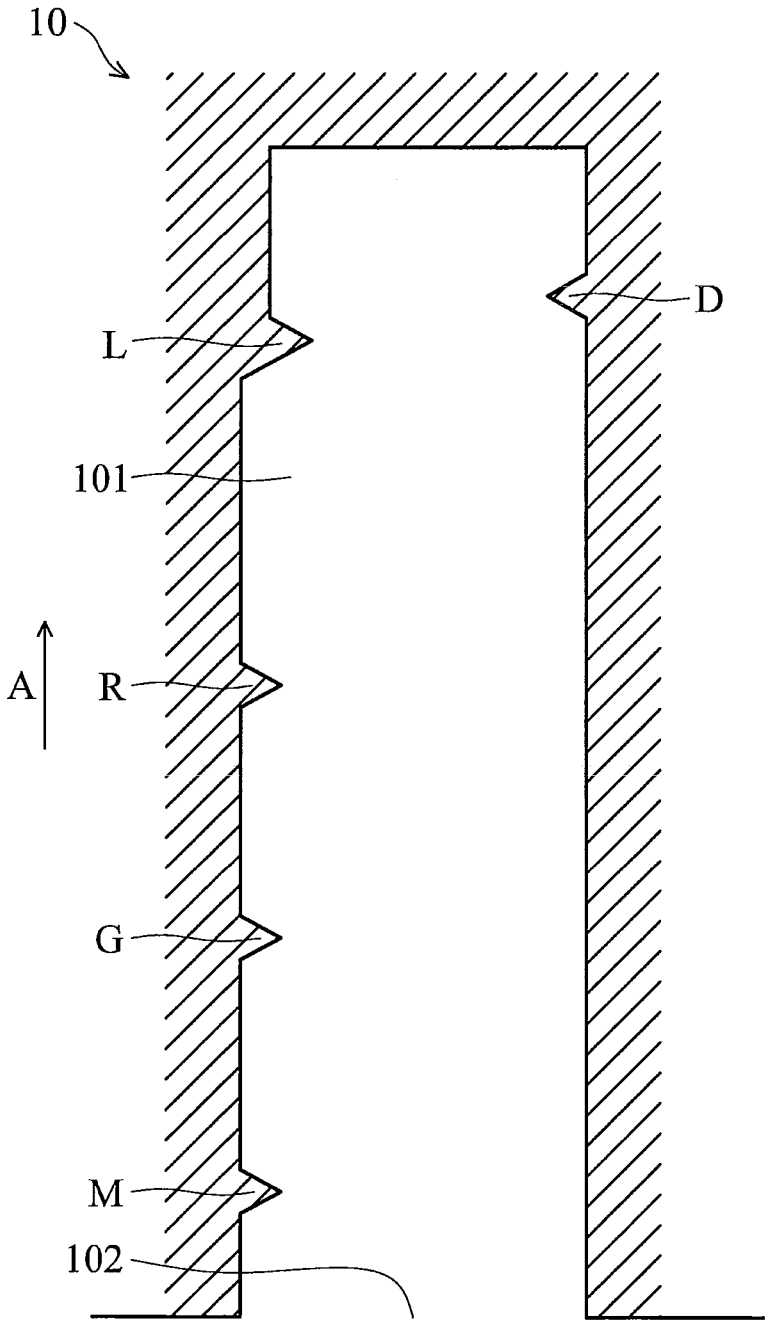
FIG. 1 is a schematic view of an audio jack according to an embodiment of the invention.
Figure 2:
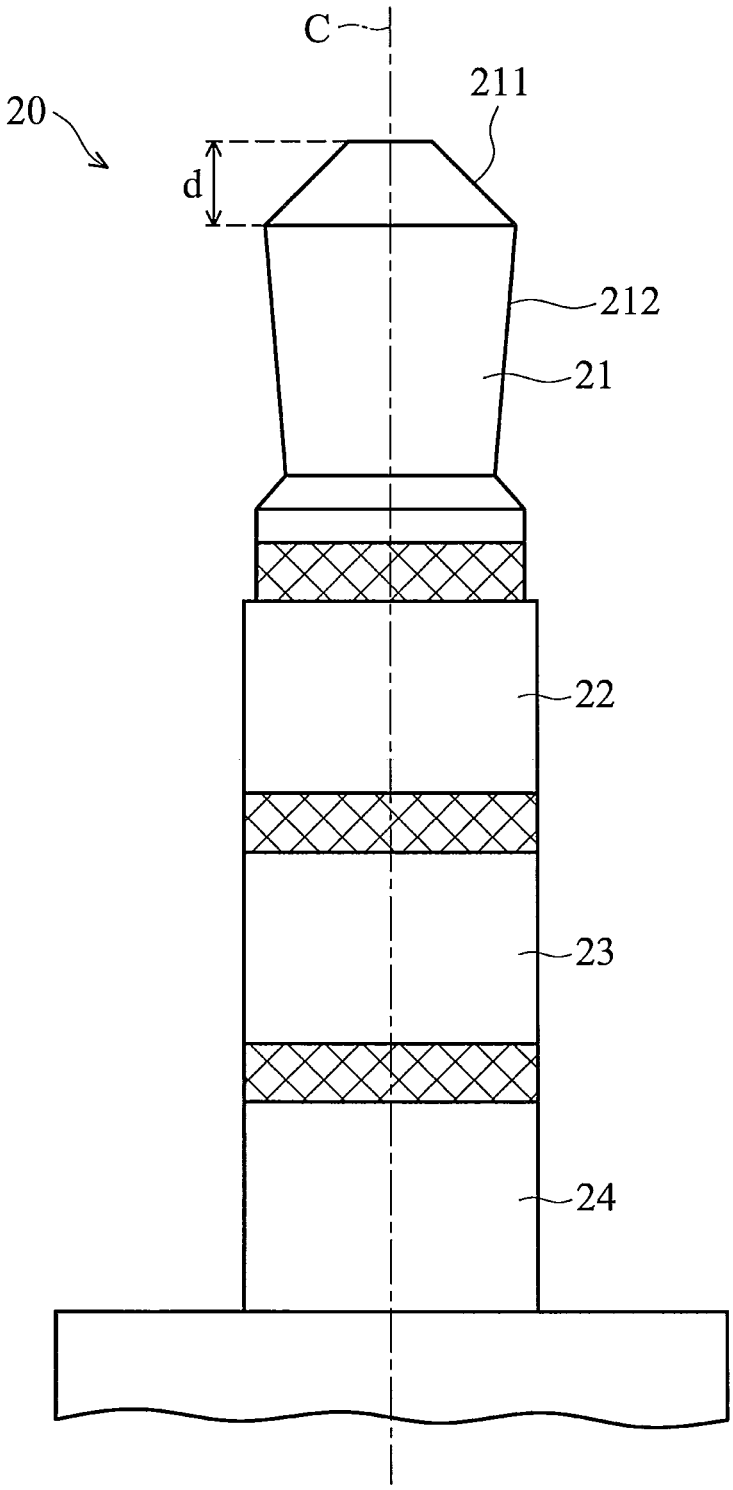
FIG. 2 is a schematic view of an audio plug according to an embodiment of the invention.
Figure 3:
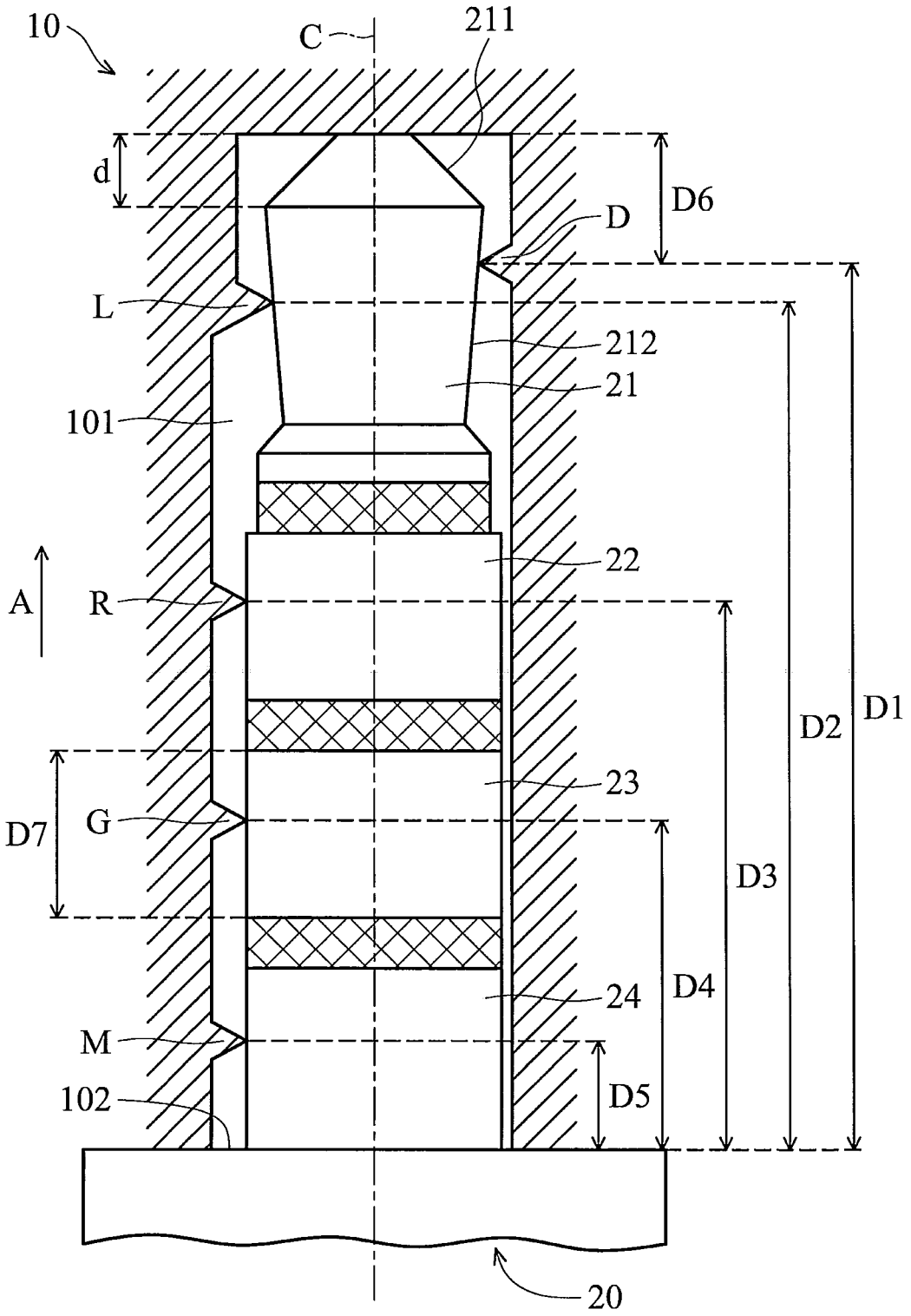
FIG. 3 is a schematic view showing an audio plug mating with an audio jack according to an embodiment of the invention.

Referring to FIGS. 1-3, an audio jack 10 according to an embodiment of the present invention is disposed in an electronic device such as mobile phone, smart phone, or notebook for receiving an audio plug 20 of a peripheral device and thus receiving or sending an audio signal through an ear phone or microphone of the peripheral device.

As shown in FIG. 1, the audio jack 10 comprises a connection hole 101 and an opening 102, the user can insert the audio plug 20 of a peripheral device through the opening 102 along a direction A in the connection hole 101 for electrically connecting to the audio jack 10. At the inner surface of the connection hole 101, a position detection portion D, a first audio channel contact portion L, a second audio channel contact portion R, a ground contact portion G, and a microphone contact portion M are sequentially disposed from the deep to the shallow side.

Referring to FIG. 2, the audio plug 20 comprises a first audio channel connection portion 21, a second audio channel connection portion 22, a ground portion 23, and a microphone channel portion 24. When the audio plug 20 is inserted through the opening 102 along the direction A in the connection hole 101 to a linking position (as shown in FIG. 3), the first audio channel connection portion 21 is electrically connected to the position detection portion D and the first audio channel contact portion L, the second audio channel connection portion 22 is electrically connected to the second audio channel contact portion R, the ground portion 23 is electrically connected to the ground contact portion G, and the microphone channel portion 24 is electrically connected to the microphone contact portion M, wherein the direction A is parallel to a central axis C of the audio plug 20.

As shown in FIG. 3, the position detection portion D, the first audio channel contact portion L, the second audio channel contact portion R, the ground contact portion G, and the microphone contact portion M respectively have a first distance D1, a second distance D2, a third distance D3, a fourth distance D4, and a fifth distance D5 to the opening 102 of the audio jack 10, wherein D1>D2>D3>D4>D5. In the same embodiments, the position detection portion D, the first audio channel contact portion L, the second audio channel contact portion R, the ground contact portion G, and the microphone contact portion M may comprise metal sheets or elastic conductive elements for electrically connecting to the audio plug 20.

When the audio plug 20 is inserted through the opening 102 along the direction A to the linking position (as shown in FIG. 3), the first audio channel contact portion L, the second audio channel contact portion R, the ground contact portion G, and the microphone contact portion M in the audio jack 10 are respectively electrically connected to the first audio channel connection portion 21, the second audio channel connection portion 22, the ground portion 23 and the microphone channel portion 24 on the audio plug 20. Thus, the audio signals can be transmitted between the electronic device and the ear phone/microphone of the peripheral device through the audio jack 10 and the audio plug 20.

In this embodiment, the first audio channel connection portion 21 comprises a tapered structure 211, which is formed at a front end of the audio plug 20 and has a length d along a tapered direction of the first audio channel connection portion 21. When the audio plug 20 mates with the audio jack 10 (as shown in FIG. 3), the position detection portion D in the audio jack 10 has a sixth distance D6 to the front end of the audio plug 20, wherein d<D6. As the sixth distance D6 is larger than the length d of the tapered structure 211 of the first audio channel connection portion 21, the position detection portion D can contact the slope surface 212 under the tapered structure 211, such that the audio plug 20 can be wedged in the audio jack 10 and be prevented from separation from the connection hole 101 along the direction opposite to the direction A.

Furthermore, the distance between the microphone contact portion M and the ground contact portion G (i.e. D4-D5) is larger than the length D7 of the ground portion 23, i.e. D4-D5>D7. Thus, when the audio plug 20 is inserted into the audio jack 10 or pulled out from the audio jack 10, the short circuit caused by the microphone contact portion M and the ground contact portion G contacting to the ground portion 23 at the same time can be prevented.

Figure 4:
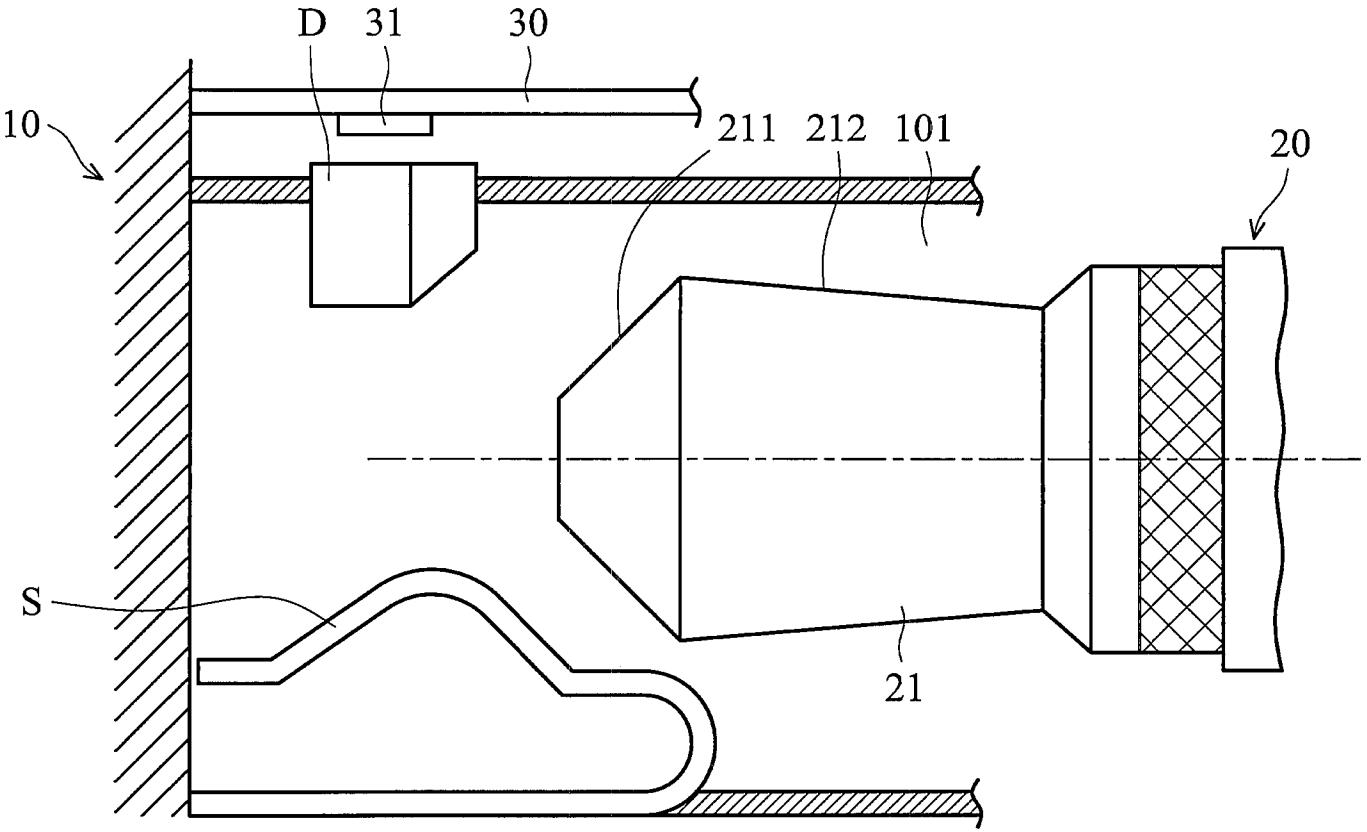
FIG. 4 is a schematic view of an audio plug before contacting a movable member according to an embodiment of the invention.
Figure 5:
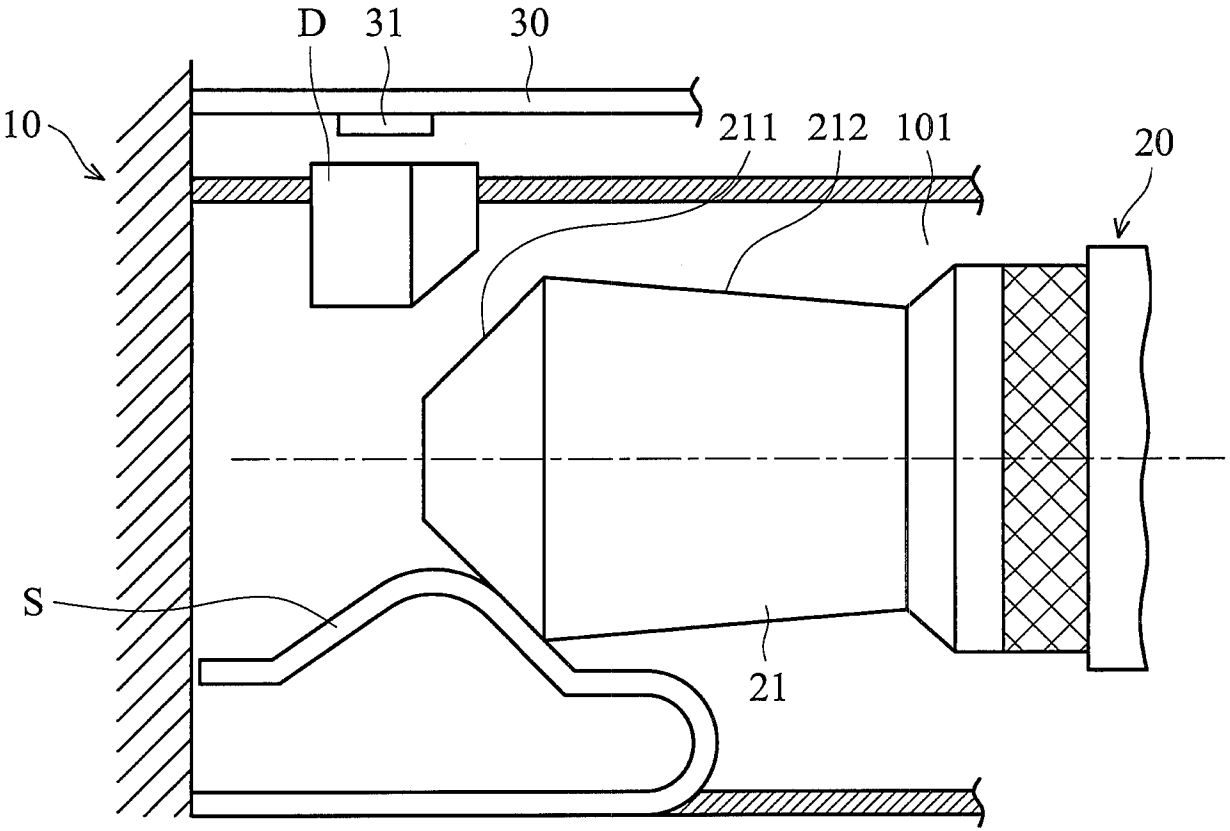
FIG. 5 is a schematic view showing an audio plug contacting a resilient member according to an embodiment of the invention.
Figure 6:
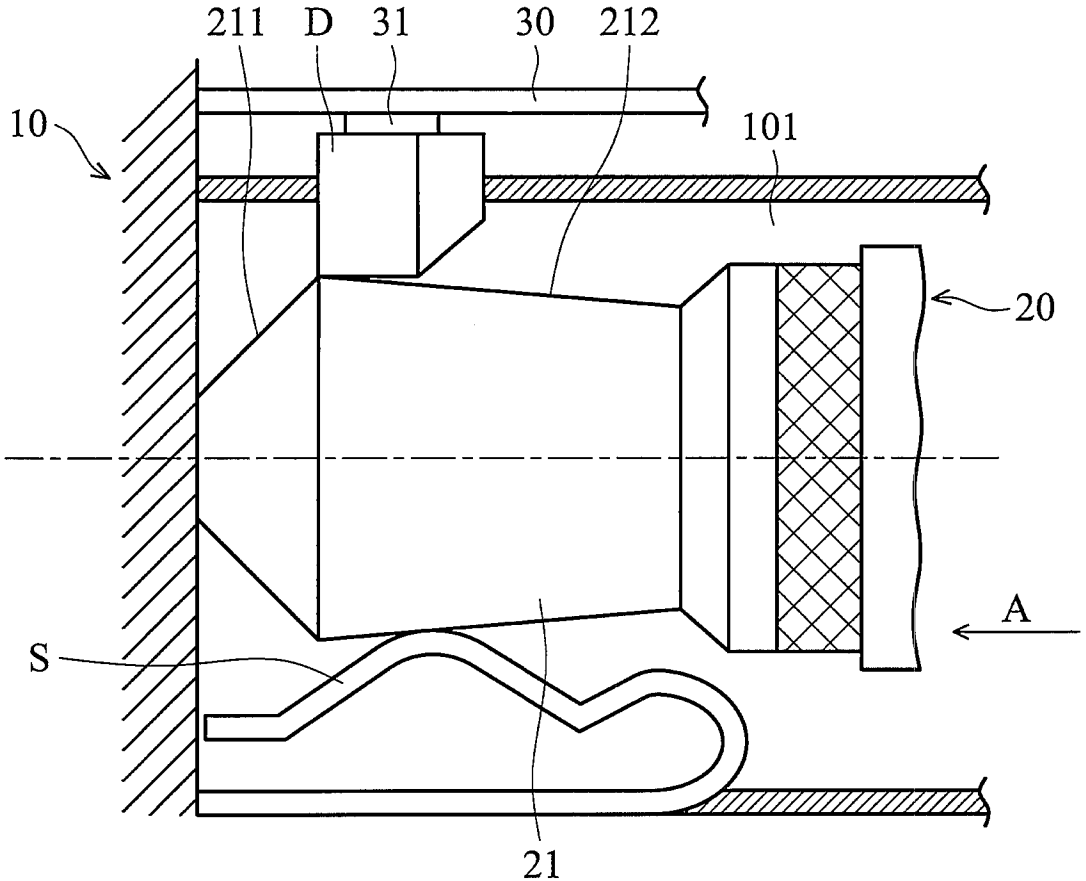
FIG. 6 is a schematic view showing an audio plug pushing the movable member for actuating a switch circuit according to an embodiment of the invention.

Referring to FIGS. 4~6, an audio jack 10 according to another embodiment of the present invention may further comprise a resilient member S projecting from the inner surface of the connection hole 101. In this embodiment, the position detection portion D in the audio jack 10 comprises a movable member, which is made of an insulative material and movably disposed on the inner surface of the connection hole 101. When the audio plug 20 is inserted into the connection hole 101, the resilient member S firstly contacts the tapered structure 211 at a front end of the audio plug 20 (FIG. 5). Thus, before the audio plug 20 is inserted to the linking position in the connection hole 101, the resilient member S can apply an elastic force to push the audio plug 20 out of the connection hole 101 along the direction opposite to the direction A. As a result, the user can feel some resistant force when inserting the audio plug 20 to the connection hole 101, so that the user can be reminded to make sure that the audio plug 20 is inserted to the liking position whereby preventing a poor contact therebetween.

As shown in FIGS. 4-6, the audio jack 10 further comprises a switch element 31, which is connected to a processor (not shown) in the electronic device through a conductive path 30. Referring to in FIG. 6, when the audio plug 20 is further inserted along the direction A in the connection hole to the linking position, the first audio channel connection portion 21 pushes the position detection portion D (movable member) toward an outer side of the connection hole 101, i.e. toward the switch element 31. As a result, the position detection portion D actuates the switch element 31 for generating an electronic signal, which is then transmitted to the processor (not shown) through the electric circuit 30, so as to confirm the full connection between the audio plug 20 and the audio jack 10.

Specially, when the audio plug 20 is inserted to the linking position in the connection hole 101, the resilient member S contacts the slope surface 212 of the first audio channel connection portion 21, and the audio plug 20 is fixed in the linking position, so that the audio plug 20 cannot be easily released from the connection hole 101. In some embodiments, the resilient member S may comprise conductive material, such as metal sheet, for replacing the first audio channel contact portion L. Alternatively, the first audio channel contact portion L may also be disposed on the resilient member S for electrically connecting the first audio channel connection portion 21 of the audio plug 20.

The present invention provides an electronic device and an audio jack 10 thereof, and the electronic device comprises an audio jack 10 and a processor, wherein the processor connects to the switch element 31 of the audio jack 10 for detecting an insertion of an audio plug 20 to the audio jack 10. The audio jack 10 is configured to be electrically mated with the audio plug 20 of a peripheral device. As the inner surface of the connection hole 101 has a position detection portion D, a first audio channel contact portion L, a second audio channel contact portion R, a ground contact portion G and a microphone contact portion M, which are sequentially disposed from the deep to the shallow side and operate with other relative mechanisms, the audio jack 10 not only meets the design specifications of the ear phone/microphone but also ensures the user that the audio plug is inserted to a predetermined position whereby making the audio plug and the audio jack electrically connect to each other.

The audio jack of the present invention is not limited to having the first audio channel contact portion L and the second audio channel contact portion R. In some embodiments, the audio jack may have only one audio channel contact portion for connecting an audio plug of a mono earphone thereto. In summary, the present invention can facilitate robust connection between the audio plug and the audio jack and ensure that they are tightly mated with each other.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An audio jack for receiving an audio plug, which has a first audio channel connection portion, comprising:

a connection hole having an opening;

a switch element;

a position detection portion disposed in the connection hole, wherein the position detection portion comprises a movable member, which is made of insulative material and movably disposed in the connection hole, and has a first distance to the opening, and wherein when the audio plug is inserted into the connection hole to a linking position, the first audio channel connection portion contacts the position detection portion, pushes the movable member of the position detection portion toward the switch element and then actuates the switch element for generating an electronic signal for confirming a full connection between the audio plug and the audio jack; and a first audio channel contact portion disposed in the connection hole, wherein the first audio channel contact portion has a second distance to the opening, which is smaller than the first distance, and wherein when the audio plug is inserted into the connection hole to the linking position, the first audio channel connection portion is electrically connected to the first audio channel contact portion.

2. The audio jack as claimed in claim 1, wherein the audio plug further comprises a second audio channel connection portion, and the audio jack further comprises a second audio channel contact portion, which is disposed in the connection hole and has a third distance to the opening, wherein the third distance is smaller than the second distance, and wherein when the audio plug is inserted into the connection hole to the linking position, the second audio channel connection portion is electrically connected to the second audio channel contact portion.

3. The audio jack as claimed in claim 2, wherein the audio plug further comprises a ground portion, and the audio jack further comprises a ground contact portion, which is disposed in the connection hole and has a fourth distance to the opening, wherein the fourth distance is smaller than the third distance, and wherein when the audio plug is inserted into the connection hole to the linking position, the ground portion is electrically connected to the ground contact portion.

4. The audio jack as claimed in claim 3, wherein the audio plug further comprises a microphone channel portion, and the audio jack further comprises a microphone contact portion, which is disposed in the connection hole and has a fifth distance to the opening, wherein the fifth distance is smaller than the fourth distance, and wherein when the audio plug is inserted into the connection hole at the linking position, the microphone channel portion is electrically connected to the microphone contact portion, and a distance between the microphone channel portion and the ground portion is larger than the length of the ground portion.

5. The audio jack as claimed in claim 1, wherein the first audio channel connection portion comprises a tapered structure, which is formed on a front end of the audio plug and has a length along a tapered direction of the first audio channel connection portion, and wherein when the audio plug is inserted into the connection hole to the linking position, the position detection portion has a sixth distance to the front end and the sixth distance is larger than the length of the tapered structure.

6. The audio jack as claimed in claim 5, wherein the audio jack further comprises a resilient member projecting from an inner surface of the connection hole, and when the audio plug is inserted into the connection hole, the resilient member contacts the tapered structure and applies an elastic force to push out the audio plug out of the connection hole.

7. The audio jack as claimed in claim 6, wherein the first audio channel contact portion is disposed on the resilient member.

8. The audio jack as claimed in claim 5, wherein the audio jack further comprises a resilient member projecting from an inner surface of the connection hole, and the first audio channel connection portion comprises a sloped surface adjacent to the tapered structure, wherein when the audio plug is inserted into the connection hole to the linking position, the resilient member contacts to the sloped surface to fix the audio plug in the connection hole.

9. The audio jack as claimed in claim 8, wherein the resilient member comprises a metal sheet.

10. An electronic device for receiving a peripheral device with an audio plug, which has a first audio channel connection portion, comprising:

a processor; and an audio jack, comprising:

a connection hole having an opening;

a switch element;

a position detection portion, disposed in the connection hole, wherein the position detection portion comprises a movable member, which is made of insulative material and movably disposed in the connection hole, and has a first distance to the opening, and wherein when the audio plug is inserted into the connection hole to a linking position, the first audio channel connection portion contacts the position detection portion, pushes the movable member of the position detection portion toward the switch element to actuate the switch element for generating an electronic signal, which is transmitted to the processor for confirming a full connection between the audio plug and the audio jack; and a first audio channel contact portion disposed in the connection hole, wherein the first audio channel contact portion has a second distance to the opening, which is smaller than the first distance, and wherein when the audio plug is inserted into the connection hole to the linking position, the first audio channel connection portion is electrically connected to the first audio channel contact portion.

11. The electronic device as in claim 10, wherein the audio plug further comprises a second audio channel connection portion, and the audio jack further comprises a second audio channel contact portion, which is disposed in the connection hole and has a third distance to the opening, wherein the third distance is smaller than the second distance, and wherein when the audio plug is inserted into the connection hole to the linking position, the second audio channel connection portion is electrically connected to the second audio channel contact portion.

12. The electronic device as in claim 11, wherein the audio plug further comprises a ground portion, and the audio jack further comprises a ground contact portion, which is disposed in the connection hole and has a fourth distance to the opening, wherein the fourth distance is smaller than the third distance, and wherein when the audio plug is inserted into the connection hole to the linking position, the ground portion is electrically connected to the ground contact portion.

13. The electronic device as in claim 12, wherein the audio plug further comprises a microphone channel portion, and the audio jack further comprises a microphone contact portion which is disposed in the connection hole and has a fifth distance to the opening, wherein the fifth distance is smaller than the fourth distance, and wherein when the audio plug is inserted into the connection hole at the linking position, the microphone channel portion is electrically connected to the microphone contact portion, and a distance between the microphone channel portion and the ground portion is larger than the length of the ground portion.

14. The electronic device as in claim 10, wherein the first audio channel connection portion comprises a tapered structure, which is formed on a front end of the audio plug and has a length along a tapered direction of the first audio channel connection portion, and wherein when the audio plug is inserted into the connection hole to the linking position, the position detection portion has a sixth distance to the front end and the sixth distance is larger than the length of the tapered structure.

15. The electronic device as in claim 14, wherein the audio jack further comprises a resilient member projecting from an inner surface of the connection hole, and when the audio plug is inserted into the connection hole, the resilient member contacts the tapered structure and applies an elastic force to push out the audio plug out of the connection hole.

16. The electronic device as in claim 15, wherein the first audio channel contact portion is disposed on the resilient member.

17. The electronic device as in claim 14, wherein the audio jack further comprises a resilient member projecting from an inner surface of the connection hole, and the first audio channel connection portion comprises a sloped surface adjacent to the tapered structure, wherein when the audio plug is inserted into the connection hole to the linking position, the resilient member contacts to the sloped surface to fix the audio plug in the connection hole.

18. The electronic device as in claim 17, wherein the resilient member comprises a metal sheet.

* * * * *